United States Patent [19]

Spira

[11] Patent Number: 4,699,279

[45] Date of Patent: Oct. 13, 1987

[54] TOWEL HOLDER

[76] Inventor: Henry Spira, 10 Rue Mazenod, 69003, Lyon, France

[21] Appl. No.: 772,347

[22] Filed: Sep. 4, 1985

[30] Foreign Application Priority Data

Sep. 5, 1984 [FR] France ..... 84 13820

[51] Int. Cl.[4] ..... A47F 5/08

[52] U.S. Cl. ..... 211/89; 211/87; 248/205.3; 248/206.2

[58] Field of Search ..... 211/89, 87; 248/205.3, 248/206.2; 15/167 A, 159

[56] References Cited

U.S. PATENT DOCUMENTS

| | | | |
|---|---|---|---|
| 904,650 | 11/1908 | Sampson | 248/206.2 |
| 1,314,625 | 9/1919 | Wedin | 211/89 |
| 1,967,783 | 7/1934 | Rudof | 15/167 A |
| 2,090,663 | 8/1937 | Booth | 15/167 A |
| 2,682,066 | 6/1954 | Keely | 15/167 A |
| 3,504,878 | 4/1970 | Dressler | 211/87 |
| 3,973,676 | 8/1976 | Brooks | 211/87 |
| 4,325,484 | 4/1982 | Berry | 211/89 |
| 4,340,144 | 7/1982 | Cousins | 211/87 |
| 4,367,819 | 1/1983 | Lewis | 211/87 |
| 4,377,240 | 3/1983 | Kleps | 211/87 |

FOREIGN PATENT DOCUMENTS

| | | | |
|---|---|---|---|
| 327532 | of 1935 | Italy | 211/89 |
| 29932 | of 1910 | United Kingdom | 211/89 |
| 1235773 | 6/1971 | United Kingdom | 211/87 |

*Primary Examiner*—Richard J. Scanlan, Jr.
*Assistant Examiner*—Anthony Knight
*Attorney, Agent, or Firm*—Stiefel, Gross, Kurland & Pavane

[57] ABSTRACT

The invention relates to a holder for towels, bathrobes and the like. The holder comprises a bundle of stiff short bristles which are held in a suitable cup-shaped member at their lower ends, with the upper ends being exposed, the cloth being engaged by said upper ends of the bristles.

3 Claims, 5 Drawing Figures

TOWEL HOLDER

FIELD OF THE INVENTION

The present invention relates to suspension means for various types of towels, such as kitchen towels and regular towels in bathrooms. The suspension means are of simple and inexpensive construction and very convenient in use.

BACKGROUND OF THE INVENTION

Generally towels are suspended from simple hooks by means of a loop attached to the towel. It is necessary to grip the loop, open it and to suspend the towel, which may require both hands to do so.

There exist holders which grip the towels by means of springy members. There exist also other suspension means where the towel is squeezed in between two adjacent members. All these are inconvenient and hard to keep in a clean state. The present invention is of simple nature and overcomes to a large extent the drawbacks of existing towel holders.

SUMMARY OF THE INVENTION

According to the present invention there is provided a simple towel holder which maintains the towel in place by simple contact. It is sufficient to contact any spot of the towel with the holder, and the towel is held in place. It can be very easily removed by simply lifting it upwards. The towel can be positioned on the holder by one hand only, and is affixed to the holder instantaneously and securely. The holder according to the present invention comprises a bundle of short stiff and essentially parallel bristles which point upwards, and which are held together at their lower part by means of a suitable cup-shaped or capsule like member which is firmly attached to a suitable holder which can be attached to the wall or any other support.

The holder of the invention can comprise a plurality of such "bristle bundles" attached at a certain distance from each other, to a suitable support, each of the "bundles" being adapted to hold a towel in place.

Such bristles may be natural ones or synthetic, such as polyester, glass fibers or the like. The bunch of bristles can be permanently embedded in a suitable support member, such as a cup-like structure during the process of manufacture. As the bristles are very close to each other, they do not penetrate the fabric of the cloth. It is advantageous to cut the upper edge of the bristles in such manner as to have a small difference of height from the apex to the sides of the bristle aggregate. The holder can be attached by conventional means to the wall or any other rigid structure. It is possible to use such devices, of a more robust construction, for suspending heavier items such as bath-towels, bath-robes or the like.

DETAILED DESCRIPTION

The invention is illustrated with reference to the enclosed schematical drawings, not according to scale, in which.

Figure 1:
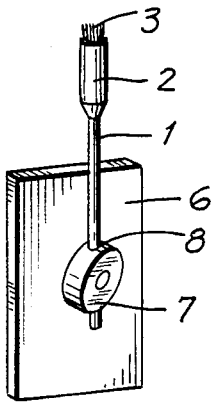
FIG. 1 is a perspective elevational view of the holder of the invention.
Figure 5:
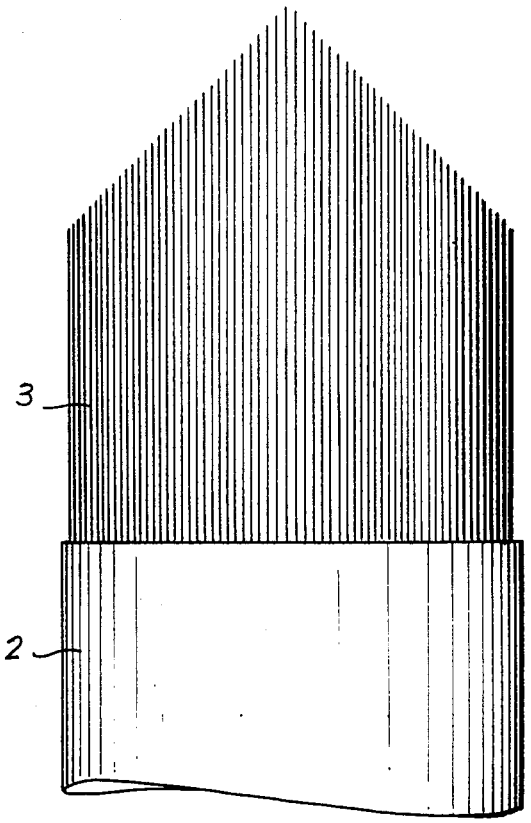
FIG. 5 is an enlarged, somewhat exaggerated view of the bristle aggregate of the holder of FIG. 1.

As shown in FIG. 1, the holder of the invention comprises in combination an upward pointing rod 1, supporting at its upper end a cup 2 which holds a bundle of stiff, short bristles 3, the said rod being held in a disk-shaped member holder provided with a self-adhesive back, which can be attached to the support 6. The disk 7 is provided with a hole 8 into which the rod 1 can be removably inserted. The bristles 3 are shown in enlargement in FIG. 5, to illustrate the difference of height from the apex to the sides of the bristle aggregate.

Figure 2:
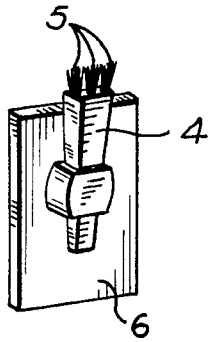
FIG. 2 illustrates another embodiment of a holder in a perspective view.
Figure 3:
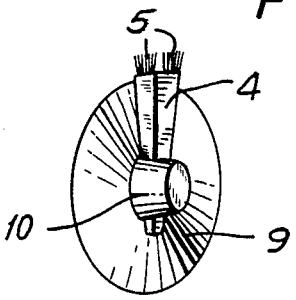
FIG. 3 illustrates yet another embodiment of a holder.

The holders illustrated in FIGS. 2 and 3 are of similar structure; a bundle of bristles 5 is embedded in the plastic cup-shaped member 4 which is held in support member 10 which is attached to the rigid member 9 or 6, respectively.

Figure 4:
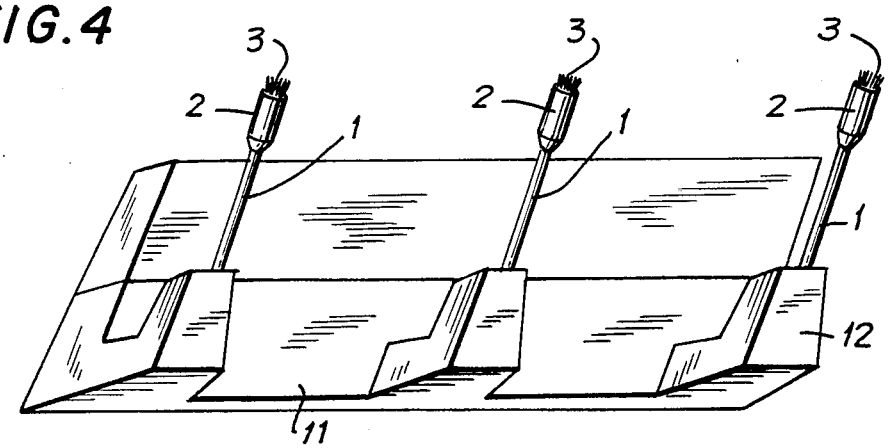
FIG. 4 is a perspective view of a holder for a plurality of items in a perspective view.

The holder illustrated in FIG. 4 comprises 3 holders for towels, each of which comprises members 1, 2 and 3 as shown in FIG. 1, which are positioned at a certain distance from each other and held in the three support members 12, which protrude from the support structure 11.

It is clear that there may be provided different embodiments of the invention, the main feature of these being the provision of upwardly pointing stiff bristle-bundles advantageously of slightly different length, which are parallel with each other and held as a closely held bunch.

I claim:

1. A towel holder for engaging and supporting a towel by simple contact, comprising:

a single bundle of essentially parallel, short, stiff upwardly pointing bristles, the upper ends of said bristles being in close packed relation to one another and differing slightly in height from one another downwardly from the apex to the sides of the bristle bundle, to support a towel without penetration of the towel by the individual bristles;

a cup-shaped member for holding the lower ends of said bristles together to support the bundle;

an element on which the cup-shaped member is mounted, and a support member securing said element and adapted to be attached to a wall or other suitable support.

2. The towel holder of claim 1, wherein the bristles comprise a stiff polymer or glass fiber material.

3. The towel holder of claim 1, comprising a plurality of said bristle bundles and holding means therefor, said bundles being spaced from one another for supporting a plurality of towels or the like.

* * * * *